US008127892B2

(12) United States Patent
Heiduk

(10) Patent No.: US 8,127,892 B2
(45) Date of Patent: Mar. 6, 2012

(54) ROPE LADDER

(76) Inventor: Dan Heiduk, Vancouver (CA)

( * ) Notice: Subject to any disclaimer, the term of this patent is extended or adjusted under 35 U.S.C. 154(b) by 704 days.

(21) Appl. No.: 11/751,620

(22) Filed: May 21, 2007

(65) Prior Publication Data

US 2008/0289904 A1 Nov. 27, 2008

(51) Int. Cl.
*E06C 1/52* (2006.01)

(52) U.S. Cl. ..... 182/196; 182/197; 182/199

(58) Field of Classification Search ..... 182/196–199
See application file for complete search history.

(56) References Cited

U.S. PATENT DOCUMENTS

| | | | | |
|---|---|---|---|---|
| 3,894,613 | A * | 7/1975 | Elizondo | 182/43 |
| 4,014,057 | A | 3/1977 | Kuojarvi | |
| 4,116,433 | A * | 9/1978 | Koerner | 482/41 |
| 4,139,079 | A | 2/1979 | Clark | |
| 4,177,878 | A | 12/1979 | Salvarezza | |
| 4,258,828 | A | 3/1981 | Evans | |
| 4,405,034 | A | 9/1983 | Dunne | |
| 4,924,970 | A * | 5/1990 | Seals et al. | 182/91 |
| 4,955,750 | A | 9/1990 | Goran | |
| 6,135,239 | A | 10/2000 | Martin | |

FOREIGN PATENT DOCUMENTS

| | | |
|---|---|---|
| CA | 2258294 | 4/1999 |
| FR | 2588239 | 10/1995 |
| GB | 604052 | 6/1948 |
| GB | 1400441 | 7/1975 |
| GB | 2326905 A | 6/1999 |
| WO | 00/00707 | 1/2000 |
| WO | 00/46477 | 8/2000 |

OTHER PUBLICATIONS

World Wide Web Creative Educational Wooden Toys http://www.cewt.co.za/photos2/j05.jpg.

* cited by examiner

*Primary Examiner* — Katherine W Mitchell
*Assistant Examiner* — Daniel Cahn

(57) ABSTRACT

The present invention relates to a method and apparatus for providing a flexible ladder for traversing a structure that addresses problems common with conventional rope ladders.

8 Claims, 5 Drawing Sheets

ROPE LADDER

BACKGROUND OF THE INVENTION

1. Field of the Invention

The present invention relates to rope ladders.

2. Description of Related Art

Ladders that have flexible stiles—colloquially "rope ladders" or in nautical usage "pilot ladders"—are better suited to certain applications than are ladders that have rigid stiles.

Rope ladders are particularly well adapted for: (a) compact storage between uses; (b) suspension, including from great height, and (c) conformance around surfaces. Thus, for example, rope ladders may be well suited for escaping from buildings, climbing into rescue helicopters, and embarking on or disembarking from large ships.

Conventional rope ladders do however present challenges; perhaps most significantly, they can be very precarious. When ascending or descending one, a user typically grasps the stiles on either side of the rungs. Problematically, although a line of force runs vertically through each stile above the point grasped, the line of force below the point grasped is redirected by the user's lower body as his legs drive the supporting rung forward. This effect can leave the user in an inverse position, with his back to the ground.

Furthermore, if one of the user's hands loses its grip on a stile, both the user and the conventional rope ladder are likely to twist away from each other, further raising the risk that the user will fall.

Additionally, when using a conventional rope ladder, it is possible for a user's hands to become pinched between the rungs and a hard surface adjacent the ladder, for example a ship or a building. Alternatively, where the adjacent surface is soft, for example the gunwale of an inflatable rubber watercraft, a conventional rope ladder may become enveloped and thereby inaccessible.

Finally, a conventional rope ladder is challenging to mount for descent, for example from a high-rise building roof or window or from a buffeted vessel such as a ship or helicopter. A user has to swing his weight backwards out over the top of the ladder and then reach down with his legs to feel for the closest rung, precariously shifting more weight outside until—hopefully—his foot securely finds a rung.

Accordingly, what is needed is a rope ladder that addresses these challenges.

SUMMARY OF THE INVENTION

The present invention is directed to this need.

According to one aspect of the present invention, there is provided a ladder having flexible first, second and third stiles and first, second and third crosspieces, respectively extending between the first and second stiles, the first and third stiles, and the second and third stiles. The three stiles are all substantially longitudinally parallel, but not all coplanar. At least one of the crosspieces resists extension and/or compression.

One end of the first crosspiece and one end of the second crosspiece might be positioned coplanar. In fact, the ends of the first, second and third crosspieces might be positioned coplanar. So positioned, the first, second and third crosspieces could form at least part of a frame.

In such a ladder having a plurality of such frames extending between the stiles and distributed along the length of the stiles, inclucing a proximate frame relatively proximate the top end of the stiles and a distal frame relatively distant from the top end of the stiles, the distal frame might have a perimeter greater than or equal to the perimeter of the proximate frame, such that the frames in effect taper larger from the top to the bottom of the ladder.

The ladder might further have a floor connected to the frame and covering at least a portion of the region bounded by the frame. This floor might be flexible pocket or a rigid platform for example, in which latter case the frame and the floor might be integral.

The frame might also include a coupler at its perimeter, adapted to engage a surface adjacent the ladder. This coupler might be a magnet for example.

The ladder might be configured such that a least one of: a) the rungs; b) the reinforcement; c) the frame; and d) the floor is flexible.

The ladder might be configured such that a least one of: a) the rungs; b) the reinforcement; c) the frame; and d) the floor is rigid.

According to another aspect of the present invention, there is provided a method of climbing such a ladder apparatus, comprising grasping the first stile, placing a foot on the first crosspiece and placing a foot on the second crosspiece.

According to yet another aspect of the present invention, there is provided a method of creating a ladder, comprising: arranging flexible first, second and third stiles substantially longitudinally parallel but not all coplanar; extending a first crosspiece between the first and second stiles; extending a second crosspiece between the first and third stiles; and extending a third crosspiece extending between the second and third stiles.

In this method, extending the second crosspiece might include extending the second crosspiece coplanar with the first crosspiece and extending the third crosspiece might extending the third crosspiece coplanar with the first and second crosspieces. The method might further include forming the first, second and third crosspieces into a frame and might include forming a floor from the frame.

Further aspects and advantages of the present invention will become apparent upon considering: the following drawings, description, and claims.

DESCRIPTION OF THE INVENTION

The invention will be more fully illustrated by the following detailed description of non-limiting specific embodiments in conjunction with the accompanying drawing figures. In the figures, similar elements and/or features may have the same reference label. Further, various elements of the same type may be distinguished by following the reference label with a second label that distinguishes among the similar elements. If only the first reference label is identified in a particular passage of the detailed description, then that passage describes any one of the similar elements having the same first reference label irrespective of the second reference label.

Figure 2:
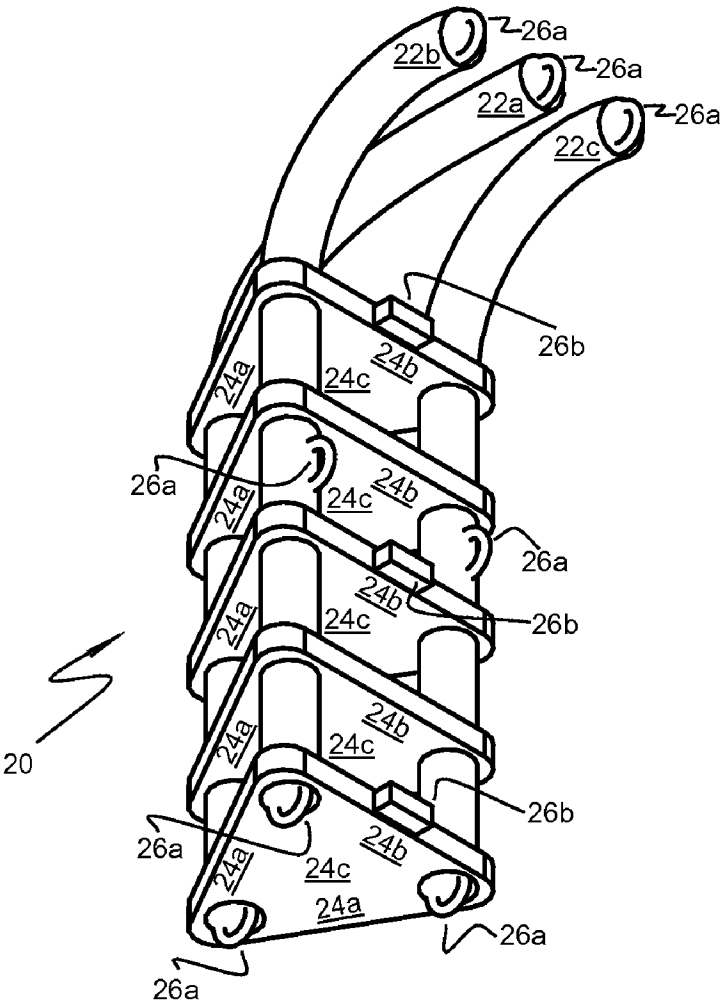
FIG. 2 is an isometric top-rear-left view of the ladder of FIG. 1.

DETAILED DESCRIPTION OF SPECIFIC EMBODIMENTS (a) Structure of Specific Embodiments The structure of the invention will now be illustrated by explanation of specific, non-limiting, exemplary embodiments shown in the drawing figures and described in greater detail herein.

(i) First Embodiment

Figure 1:
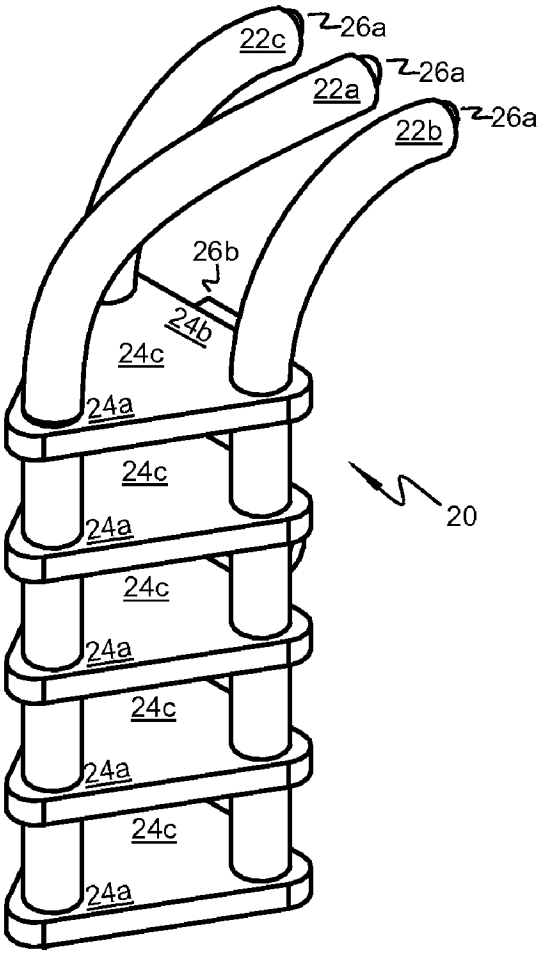
FIG. 1 is an isometric top-front-right view of a first embodiment of a ladder according to one aspect of the present invention.

FIGS. 1 and 2 show a rope ladder according to a first embodiment of the present invention, generally illustrated at 20. The ladder 20 has more than two stiles 22, and in this particular embodiment has a first stile 22*a*, a second stile 22*b*, and a third stile 22*c*. The stiles 22 are strong and flexible and can be formed from cable, chain, natural or synthetic rope, plastic, rubber or the like.

The ladder 20 further includes crosspieces 24 that extend between two or more of the stiles 22. A crosspiece 24 may function as a rung 24*a* adapted to support a person and/or a payload, a reinforcement 24*b* adapted to reinforce a relative position between adjacent stiles 22, or both. The rungs 24*a* and reinforcements 24*b* may thus be similar or identical crosspieces 24 or else may differ according to the requirements of their different functions. For example, reinforcements 24*b* may offer resistance in compression, tension or both. In this regard, the crosspieces 24 may be fashioned from rigid materials including wood, metal, rubber, plastic and composites or flexible materials including chain, cable and rope as necessary to support a person and/or payload, to reinforce a relative position between stiles 22, or both. Rungs 24*a* must be constructed sufficiently to support a load against gravity.

The crosspieces 24 might be connected to the stiles 22 in any suitable conventional way, whether removably, semi-permanently, or permanently. For example, a stile 22 might be passed through a hole in a crosspiece 24 and then tied into a knot larger than the hole below—and perhaps above—the crosspiece 24. Instead of a hole, the crosspiece 24 might include a notch that positively bites into the stile 22 and retains the stile 22 within. The stile 22 might be connected to the crosspiece 24 with hardware fasteners or adhesives. The stile 22 might be fused to or otherwise integrated with the crosspiece; for example, a rope or wire crosspiece 24 might be braided into a rope or wire stile 22.

Crosspieces 24 might be of various shapes. They might be elongate. They might be polygonal or polyhedral for example. Portions of a crosspiece 24 might extend radially outside a perimeter defined by the stiles 22.

In the subject embodiment, all of the crosspieces 24 function as both rungs 24*a* and reinforcements 24*b*, and in fact extend between all three of the first stile 22*a*, the second stile 22*b* and the third stile 22*c*, to retain the stiles 22 in relative position and to provide a broad platform 24*c* there between.

The ladder 20 further includes couplers 26 to couple the ladder 20 to a structure S to be traversed (not shown), for example a ship, or the ground G (not shown). Depending on the nature of the coupling desired—fixed, flexible, slideable, rotatable, permanent, temporary, safety, primary, secondary, redundant, etc.—the particulars of the coupler 26 will vary. A coupler might, for example, include a shackle, lug, eye, fastener, magnet, tie, clasp, grapple, adhesive, bushing, bearing, or the like.

The couplers may be stile-couplers 26*a* or crosspiece-couplers 26*b*. A stile-coupler26*a* is adapted to couple an end or an intermediate section of a stile 22 to the structure S or the ground G. A crosspiece-coupler 26*b* is adapted to couple a crosspiece 24 to the structure S.

(ii) Second Embodiment

Figure 3:
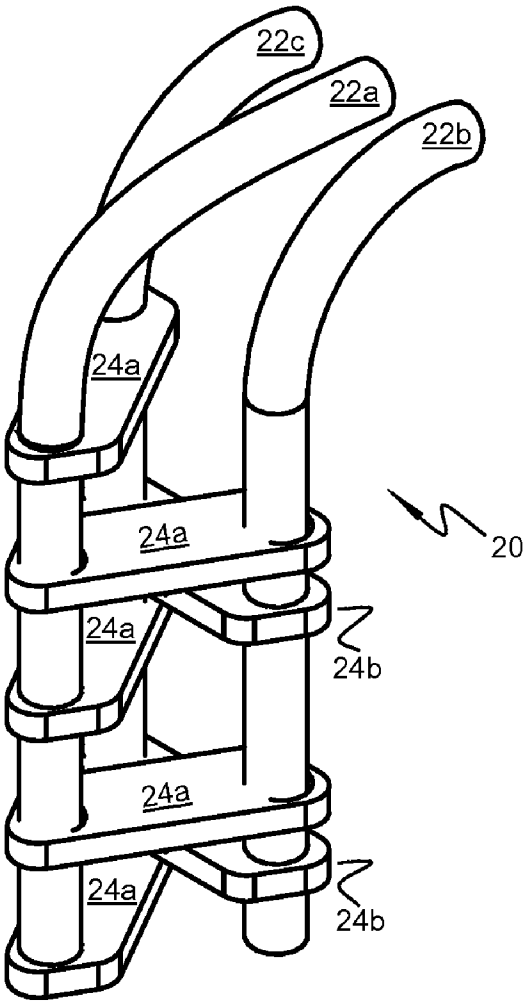
FIG. 3 is an isometric top-front-right view of a second embodiment of a ladder according to another aspect of the present invention.

FIG. 3 shows a ladder 20 according to a second embodiment of the present invention, wherein rungs 24*a* extending between the first stile 22*a* and the second stile 22*b* are not coplanar with rungs 24*a* extending between the first stile 22*a* and the third stile 22*c*, and neither are coplanar with reinforcements 24*b* extending between the second stile 22*b* and the third stile 22*c*.

(iii) Third Embodiment

Figure 4:
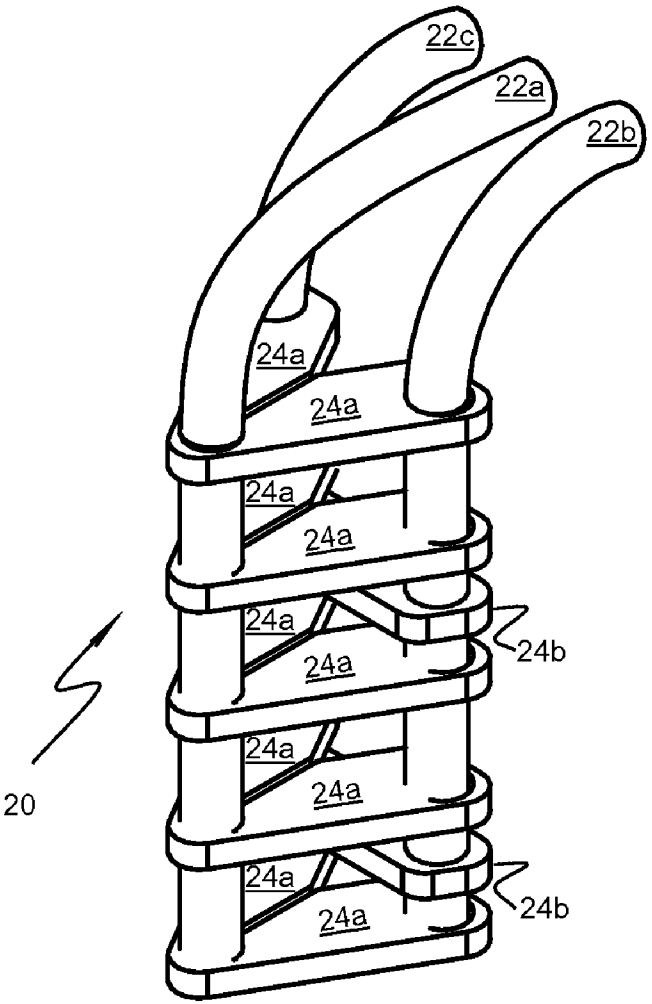
FIG. 4 is an isometric top-front-right view of a third embodiment of a ladder according to another aspect of the present invention.

FIG. 4 shows a ladder 20 according to a third embodiment of the present invention, wherein rungs 24*a* extending between the first stile 22*a* and the second stile 22*b* are coplanar with rungs 24*a* extending between the first stile 22*a* and the third stile 22*c*, but neither are coplanar with reinforcements 24*b* extending between the second stile 22*b* and the third stile 22*c*.

(iv) Fourth Embodiment

Figure 5:
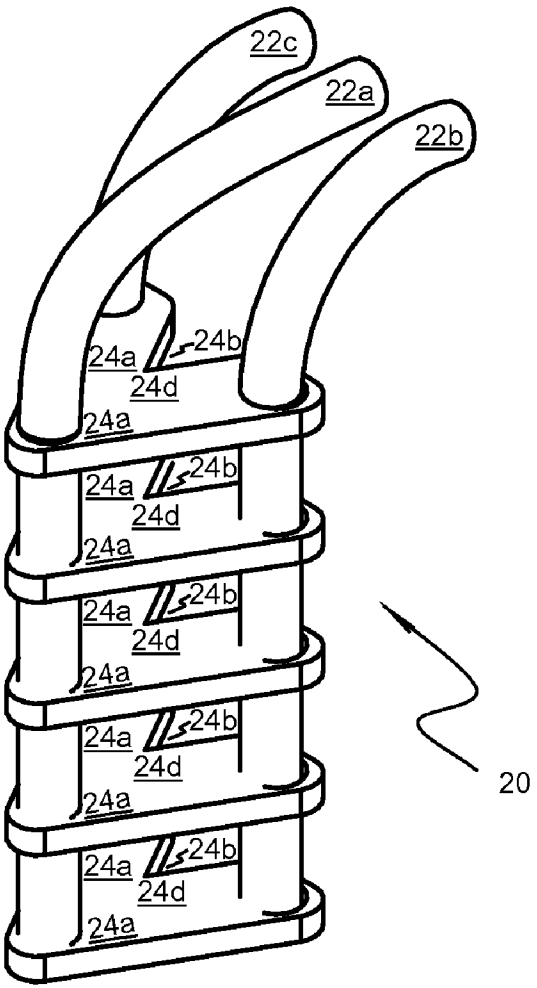
FIG. 5 is an isometric top-front-right view of a fourth embodiment of a ladder according to another aspect of the present invention.

FIG. 5 shows a ladder 20 according to a fourth embodiment of the present invention, wherein rungs 24*a* extending between the first stile 22*a* and the second stile 22*b* are coplanar with rungs 24*a* extending between the first stile 22*a* and the third stile 22*c* and coplanar with reinforcements 24*b* extending between the second stile 22*b* and the third stile 22*c*. In this embodiment, the coplanar rungs 24*a* and reinforcements 24*b* may cooperate or otherwise be connected together or formed integrally to create a frame 24*d* to better retain crosspieces 24 and stiles 22 in a desired relative configuration.

(v) Fifth Embodiment

Figure 6:
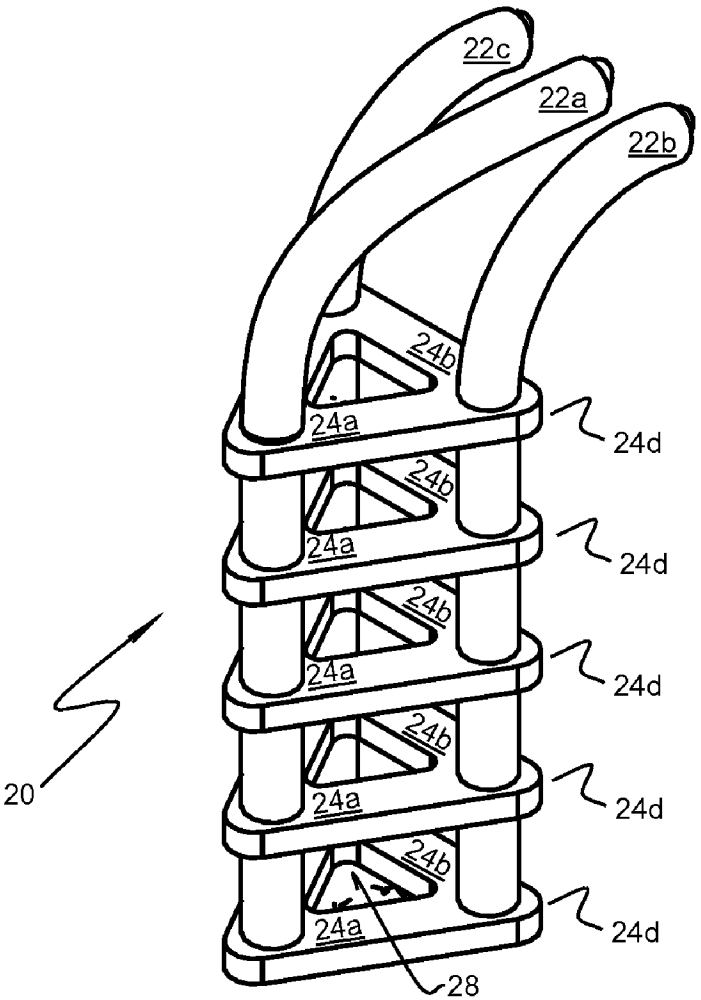
FIG. 6 is an isometric top-front-right view of a fifth embodiment of a ladder according to another aspect of the present invention.

FIG. 6 shows a ladder 20 according to a fifth embodiment of the present invention, wherein a frame 24*d* extending between the three stiles 22 supports a flexible pocket 28, for example a mesh pocket 28, adapted to support a person and/or a payload. Those skilled in the art will note that a user might traverse the ladder 20 through the center of the frame 24*d*

(vi) Sixth Embodiment

Figure 7:
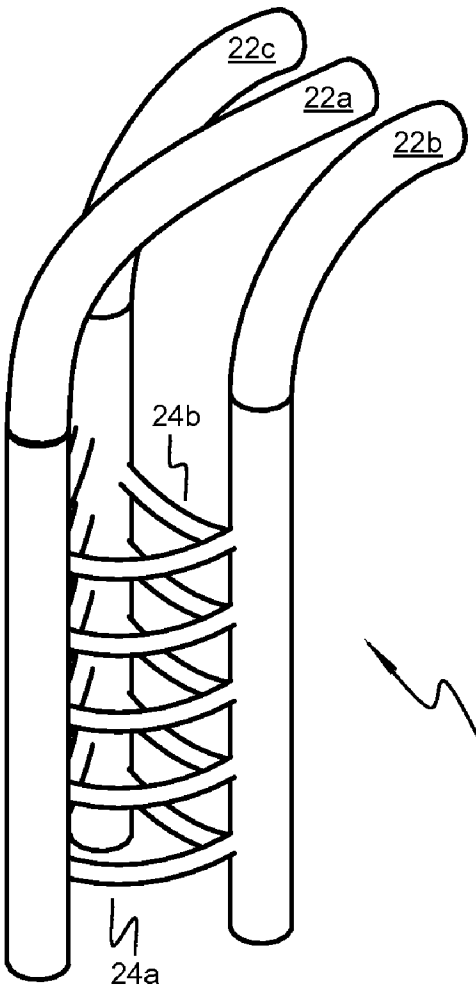
FIG. 7 is an isometric top-front-right view of a sixth embodiment of a ladder according to another aspect of the present invention.

FIG. 7 shows a ladder 20 according to a sixth embodiment of the present invention, wherein the rungs 24*a* and reinforcements 24*b* are fashioned from a flexible material, for example rope, wire, chain, or rubber or plastic extrusion, either solid or tubing.

(vii) Seventh Embodiment

Figure 8:
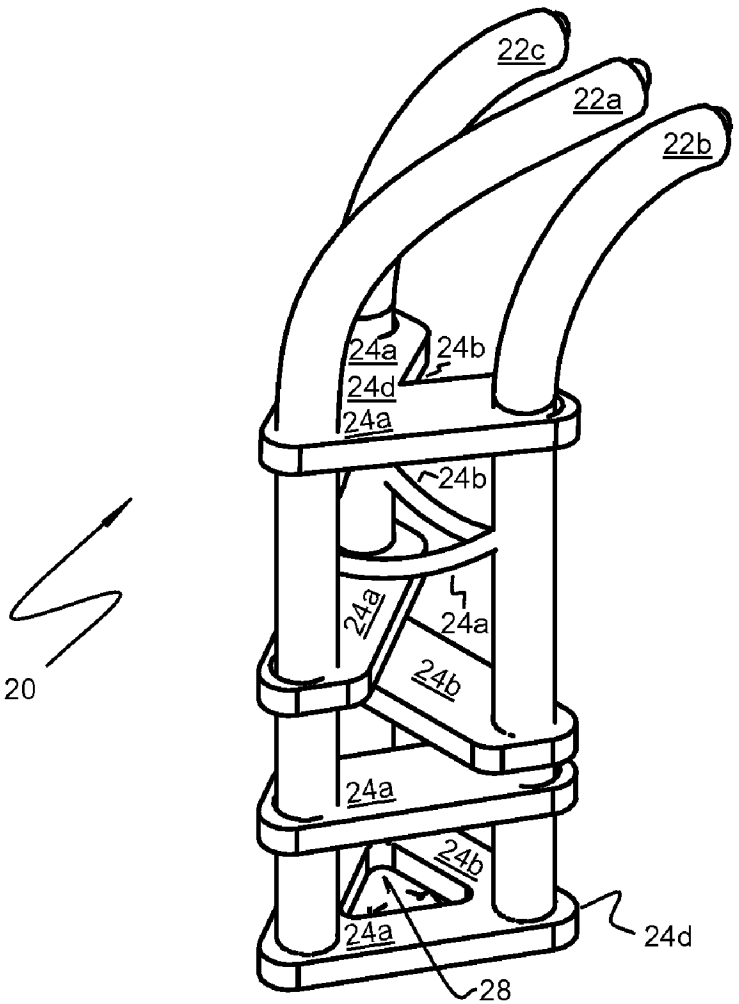
FIG. 8 is an isometric top-front-right view of a seventh embodiment of a ladder according to another aspect of the present invention.

FIG. 8 shows a ladder 20 according to a seventh embodiment of the present invention, wherein the crosspieces 24 are configured differently at different positions along the length of the ladder 20, for example being selected as an assortment of some crosspieces 24 of the previous six embodiments. Such variation might better support specific tasks correlated to elevation, either absolute over the ground G or relative to the structure S, or correlated to a position along the ladder 20.

(viii) Eighth Embodiment

Figure 9:
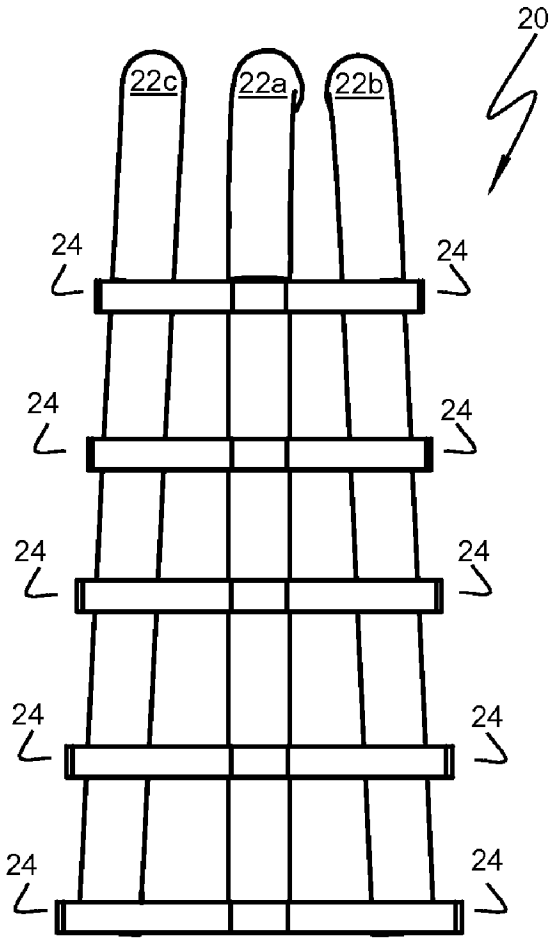
FIG. 9 is an top elevational view of an eighth embodiment of a ladder according to another aspect of the present invention.

FIG. 9 shows a ladder 20 according to an eighth embodiment of the present invention, wherein the span between the stiles 22 tapers larger from top to bottom, so that the crosspieces 24 increase in length and the platforms 24*c* increase in area. Alternatively, successively lower crosspieces 24 might increase in length and platforms 24*c* might increase in area independently of the span between stiles 22.

(ix) Ninth Embodiment

Figure 10:
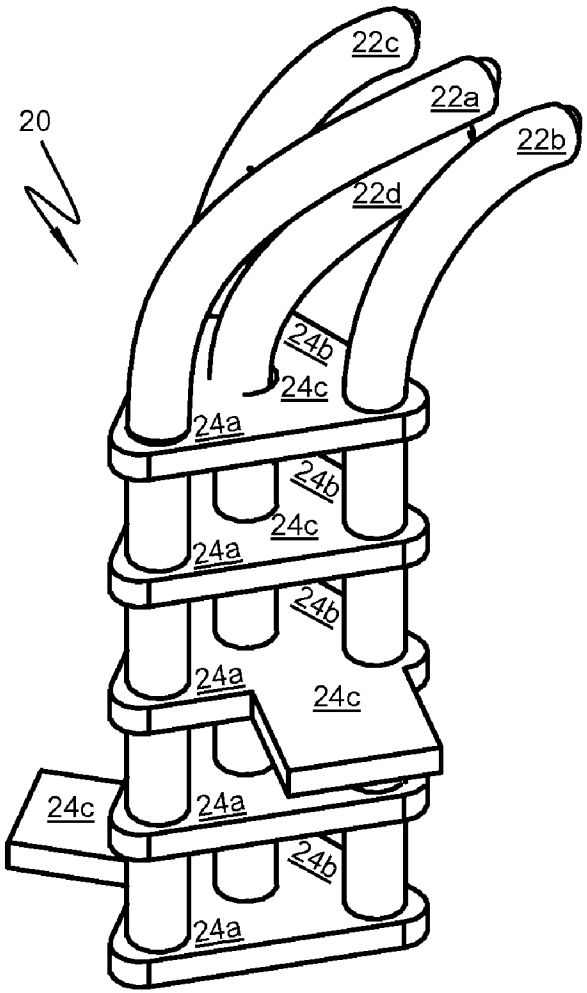
FIG. 10 is an isometric top-front-right view of a ninth embodiment of a ladder according to another aspect of the present invention.

FIG. 10 shows a ladder 20 according to a ninth embodiment of the present invention that further includes a fourth stile 22*d*, wherein crosspieces 24 extend between the four stiles 22, creating platforms 24*c*, portions of which function as rungs 24*a* and portions of which function as reinforcements 24*b*.

(b) Operation of Specific Embodiments

With reference now to FIGS. 1-10, the operation of these specific embodiments of the invention will now be described.

The ladder 20 may be created by arranging more than two stiles 22 substantially in parallel but not all of them coplanar, having regard to their respective longitudinal axes. Adjacent stiles 22 may then be connected with crosspieces 24, for example in any of the forms or arrangements described above, at least some of the crosspieces 24 functioning as reinforcements 24*b* to urge at least some of the stiles 22 into a particular relative arrangement.

The crosspieces 24 may be so connected either removably, semi-permanently, or permanently. Depending on the nature of this connection, the ladder 20 may be furled as a fully-assembled whole for convenient storage and transportation to a job site or else the stiles 22 can be furled and the crosspieces bundled or stacked, for convenient storage and transportation but subsequent assembly at a job site.

In use, the ladder 20 may be connected with couplers 26 to a structure S to be traversed. In this regard, the stiles 22 would typically be so coupled, but at least some of the crosspieces 24 might also be coupled to further resist movement. For further support, some of the stiles 22 might be coupled to the ground G.

A user would generally grasp one stile 22 and step on the crosspieces 24 extending from that stile 22, using such crosspieces 24 as rungs 24*a*. Where the crosspieces form a platform 24*c* or support a pocket 28, the user might rest a payload either to pause in his traverse or to provide a storage or work surface.

Once the ladder 20 is no longer needed, the couplers 26 can be disengaged from the structure S and the ground G, and the ladder 20 furled, after perhaps being disassembled, for convenient storage until its next use (c) Description Summary Thus, it will be seen from the foregoing embodiments and examples that there has been described a way to provide a flexible ladder 20 for traversing a structure S that addresses problems common with pilot ladders.

While specific embodiments of the invention have been described and illustrated, such embodiments should be considered illustrative of the invention only and not as limiting the invention as construed in accordance with the accompanying claims. In particular, all quantities described have been determined empirically and those skilled in the art might well expect a wide range of values surrounding those described to provide similarly beneficial results.

It will be understood by those skilled in the art that various changes, modifications and substitutions can be made to the foregoing embodiments without departing from the principle and scope of the invention expressed in the claims made herein. For example, although in many of the embodiments the crosspieces 24 have been arranged in a generally triangular configuration, other configurations could be equally well or better adapted for various applications.

While the invention has been described as having particular application for shipping and evacuation, those skilled in the art will recognize it has wider application.

TABLE OF REFERENCES

| Element(s) | Reference | Total count | Page and line |
|---|---|---|---|
| ladder | 20 | 21 | Page 6 line 18 |
| | | | Page 7 line 3 |
| | | | Page 8 line 10 |
| | | | Page 8 line 10 |
| | | | Page 9 line 2 |
| | | | Page 9 line 8 |
| | | | Page 9 line 14 |
| | | | Page 10 line 2 |
| | | | Page 10 line 6 |
| | | | Page 10 line 8 |
| | | | Page 10 line 13 |
| | | | Page 10 line 15 |
| | | | Page 10 line 19 |
| | | | Page 11 line 2 |
| | | | Page 11 line 9 |
| | | | Page 11 line 16 |
| | | | Page 12 line 5 |
| | | | Page 12 line 9 |
| | | | Page 12 line 17 |
| | | | Page 12 line 18 |
| | | | Page 13 line 3 |
| stiles | 22 | 19 | Page 6 line 19 |
| | | | Page 7 line 1 |
| | | | Page 7 line 4 |
| | | | Page 7 line 6 |
| | | | Page 7 line 13 |
| | | | Page 7 line 15 |
| | | | Page 8 line 5 |
| | | | Page 8 line 8 |
| | | | Page 9 line 20 |
| | | | Page 10 line 3 |
| | | | Page 11 line 3 |
| | | | Page 11 line 7 |
| | | | Page 11 line 11 |
| | | | Page 11 line 16 |
| | | | Page 11 line 18 |
| | | | Page 12 line 2 |
| | | | Page 12 line 6 |
| | | | Page 12 line 10 |
| | | | Page 12 line 12 |
| stile | 22 | 34 | Page 6 line 19 |
| | | | Page 6 line 19 |
| | | | Page 7 line 1 |
| | | | Page 7 line 17 |
| | | | Page 7 line 20 |
| | | | Page 7 line 20 |
| | | | Page 7 line 20 |
| | | | Page 7 line 21 |
| | | | Page 8 line 2 |
| | | | Page 8 line 7 |
| | | | Page 8 line 8 |
| | | | Page 8 line 8 |
| | | | Page 8 line 18 |
| | | | Page 9 line 3 |
| | | | Page 9 line 4 |
| | | | Page 9 line 4 |
| | | | Page 9 line 5 |
| | | | Page 9 line 6 |
| | | | Page 9 line 6 |
| | | | Page 9 line 9 |
| | | | Page 9 line 10 |
| | | | Page 9 line 10 |
| | | | Page 9 line 11 |
| | | | Page 9 line 12 |
| | | | Page 9 line 12 |

-continued

TABLE OF REFERENCES

| Element(s) | Reference | Total count | Page and line |
|---|---|---|---|
| | | | Page 9 line 15 |
| | | | Page 9 line 16 |
| | | | Page 9 line 16 |
| | | | Page 9 line 17 |
| | | | Page 9 line 18 |
| | | | Page 9 line 18 |
| | | | Page 11 line 10 |
| | | | Page 12 line 13 |
| | | | Page 12 line 14 |
| first stile | 22a | 8 | Page 6 line 19 |
| | | | Page 8 line 7 |
| | | | Page 9 line 3 |
| | | | Page 9 line 4 |
| | | | Page 9 line 9 |
| | | | Page 9 line 10 |
| | | | Page 9 line 15 |
| | | | Page 9 line 16 |
| second stile | 22b | 8 | Page 6 line 19 |
| | | | Page 8 line 8 |
| | | | Page 9 line 4 |
| | | | Page 9 line 6 |
| | | | Page 9 line 9 |
| | | | Page 9 line 12 |
| | | | Page 9 line 15 |
| | | | Page 9 line 17 |
| third stile | 22c | 8 | Page 7 line 1 |
| | | | Page 8 line 8 |
| | | | Page 9 line 5 |
| | | | Page 9 line 6 |
| | | | Page 9 line 11 |
| | | | Page 9 line 12 |
| | | | Page 9 line 17 |
| | | | Page 9 line 18 |
| fourth stile | 22d | 1 | Page 11 line 10 |
| crosspieces | 24 | 19 | Page 7 line 3 |
| | | | Page 7 line 7 |
| | | | Page 7 line 10 |
| | | | Page 7 line 15 |
| | | | Page 8 line 3 |
| | | | Page 8 line 6 |
| | | | Page 9 line 20 |
| | | | Page 10 line 14 |
| | | | Page 10 line 16 |
| | | | Page 11 line 4 |
| | | | Page 11 line 5 |
| | | | Page 11 line 10 |
| | | | Page 11 line 19 |
| | | | Page 12 line 1 |
| | | | Page 12 line 3 |
| | | | Page 12 line 11 |
| | | | Page 12 line 13 |
| | | | Page 12 line 14 |
| | | | Page 13 line 14 |
| crosspiece | 24 | 8 | Page 7 line 4 |
| | | | Page 7 line 17 |
| | | | Page 7 line 18 |
| | | | Page 7 line 19 |
| | | | Page 7 line 21 |
| | | | Page 8 line 1 |
| | | | Page 8 line 4 |
| | | | Page 8 line 20 |
| rungs | 24a | 13 | Page 7 line 6 |
| | | | Page 7 line 13 |
| | | | Page 8 line 6 |
| | | | Page 9 line 3 |
| | | | Page 9 line 4 |
| | | | Page 9 line 9 |
| | | | Page 9 line 10 |
| | | | Page 9 line 15 |
| | | | Page 9 line 16 |
| | | | Page 9 line 18 |
| | | | Page 10 line 9 |
| | | | Page 11 line 12 |
| | | | Page 12 line 14 |
| rung | 24a | 1 | Page 7 line 4 |
| reinforcements | 24b | 10 | Page 7 line 7 |

-continued

TABLE OF REFERENCES

| Element(s) | Reference | Total count | Page and line |
|---|---|---|---|
| | | | Page 7 line 9 |
| | | | Page 8 line 7 |
| | | | Page 9 line 5 |
| | | | Page 9 line 11 |
| | | | Page 9 line 17 |
| | | | Page 9 line 19 |
| | | | Page 10 line 9 |
| | | | Page 11 line 12 |
| | | | Page 12 line 1 |
| reinforcement | 24b | 1 | Page 7 line 5 |
| platform | 24c | 2 | Page 8 line 9 |
| | | | Page 12 line 15 |
| platforms | 24c | 3 | Page 11 line 4 |
| | | | Page 11 line 6 |
| | | | Page 11 line 11 |
| frame | 24d | 3 | Page 9 line 20 |
| | | | Page 10 line 3 |
| | | | Page 10 line 6 |
| couplers | 26 | 5 | Page 8 line 10 |
| | | | Page 8 line 17 |
| | | | Page 8 line 17 |
| | | | Page 12 line 9 |
| | | | Page 12 line 17 |
| coupler | 26 | 3 | Page 8 line 14 |
| | | | Page 8 line 18 |
| | | | Page 8 line 19 |
| stile-couplers | 26a | 1 | Page 8 line 17 |
| stile-coupler | 26a | 1 | Page 8 line 17 |
| crosspiece-coupler | 26b | 1 | Page 8 line 19 |
| crosspiece-couplers | 26b | 1 | Page 8 line 17 |
| pocket | 28 | 3 | Page 10 line 4 |
| | | | Page 10 line 4 |
| | | | Page 12 line 15 |
| ground | G | 5 | Page 8 line 11 |
| | | | Page 8 line 19 |
| | | | Page 10 line 18 |
| | | | Page 12 line 12 |
| | | | Page 12 line 18 |
| structure | S | 7 | Page 8 line 11 |
| | | | Page 8 line 19 |
| | | | Page 8 line 20 |
| | | | Page 10 line 18 |
| | | | Page 12 line 9 |
| | | | Page 12 line 18 |
| | | | Page 13 line 4 |

What is claimed is:

1. A ladder apparatus for traversing a structure, the ladder apparatus consisting of:

a) a plurality of substantially triangular crosspieces, each of the plurality of crosspieces having a first, second and third vertex respectively; and b) first, second and third stiles, each of the first, second and third stiles being directly connected to each of the plurality of crosspieces at the first, second and third vertex respectively, each of the stiles respectively having a bottom end and a top end and at least one coupler for coupling to a structure; and c) each said stile is strong and flexible and made from a material selected from the group consisting of cable, chain, and natural or synthetic rope; and d) said at least one coupler on each said stile respectively being connected at a location selected from the group consisting of the top, the bottom and an intermediate location between the top and the bottom of each stile respectively; and e) optionally, at least one magnet attached to at least one of said triangular crosspieces.

2. An apparatus as claimed in claim 1, wherein the bottom end of at least one of the stiles has a bottom coupler for coupling to the ground.

3. An apparatus as claimed in claim 1, further including an intermediate coupler for coupling to the structure, the intermediate coupler being connected to one of the stiles between the top end of the one of the stiles and the bottom end of the one of the stiles.

4. An apparatus as claimed in claim 1, wherein at least one of the plurality of crosspieces has a crosspiece coupler for coupling to the structure.

5. A method of installing the ladder of claim 1 for traversing a structure, the method comprising:

a) providing a plurality of substantially triangular crosspieces, each of the plurality of crosspieces having a first, second and third vertex, b) providing first, second and third flexible stiles, each of the first, second and third stiles being connected to each of the plurality of crosspieces at respectively the first, second and third vertex, each of the stiles having a bottom end and a top end having a respective top coupler for coupling to the structure, and c) coupling the top end of each of the stiles to the structure.

6. The method as claimed in claim 5, further including coupling the bottom end of at least one of the stiles to the ground.

7. The method as claimed in claim 5, further including coupling at least one of the stiles to the structure at a section intermediate the top end of the at least one of the stiles and the bottom end of the at least one of the stiles.

8. The method as claimed in claim 5, further including coupling at least one of the crosspieces to the structure.

* * * * *